United States Patent [19]

Takahashi

[11] 4,024,355

[45] May 17, 1977

[54] PIEZOELECTRIC ELECTRO-ACOUSTIC TRANSDUCER WITH NON-UNIFORM BACKING

[75] Inventor: Gaiko Takahashi, Tokorozawa, Japan

[73] Assignee: Pioneer Electronic Corporation, Tokyo, Japan

[22] Filed: Nov. 24, 1975

[21] Appl. No.: 634,377

[30] Foreign Application Priority Data

Nov. 27, 1974 Japan ..... 49-144045

[52] U.S. Cl. ..... 179/110 A; 310/9.4

[51] Int. Cl.² ..... H04R 17/00

[58] Field of Search ..... 179/110 A, 180; 181/166; 179/1 ST; 310/9.4

[56] References Cited

UNITED STATES PATENTS 3,832,580 8/1974 Yamamuro et al. ..... 179/110 A

FOREIGN PATENTS OR APPLICATIONS 590,996 12/1933 Germany ..... 179/110 A

*Primary Examiner*—George G. Stellar

*Attorney, Agent, or Firm*—Woodhams, Blanchard and Flynn

[57] ABSTRACT

An electro-acoustic transducer with a piezoelectric diaphragm which is backed with a resilient backing member having a protruded section for imparting a suitable resiliency and/or tension to the diaphragm to highly improve its acoustic characteristics with a simple construction.

7 Claims, 9 Drawing Figures

PIEZOELECTRIC ELECTRO-ACOUSTIC TRANSDUCER WITH NON-UNIFORM BACKING

This invention relates to a piezoelectric electro-acoustic transducer employing a diaphragm made of a film of a piezoelectric material and wherein a suitable resiliency and/or tension is imparted to the diaphragn, and more particularly to an improvement in a piezoelectric electro-acoustic transducer of this kind in which a resilient backing member fitted to the diaphragm to impart the suitable resiliency and/or tension to the diaphragm, is provided with a protruded section, thereby to provide improved or desired acoustic characteristics.

As disclosed in U.S. Pat. No. 3,832,580, the high molecular weight polymer materials such as polyvinylidene fluoride (PVDF) and poly-γ-glutamic acid methyl ester (PMG) have a piezoelectricity and a thin film of such materials as mentioned above can be used to form an electro-acoustic transducer to eliminate such disadvantages as an excessively high resonance frequency, excessive hardness for working and heaviness in weight which are encountered in conventional bimorph vibrators.

An object of the present invention is to provide an electro-acoustic transducer with a piezoelectric thin film and a resilient backing member which has protruded section to impart the suitable resiliency and/or tension to said thin film to present desired characteristics.

According to the present invention, there is provided in a piezoelectric electro-acoustic transducer employing a diaphragm made of a flexible piezoelectric material and comprising a support means of an appropriately stiff material, a resilient backing member fitted to the diaphragm to impart at least one of a resiliency and tension to the diaphragm, and a base plate of stiff material adapted to compressively cover the resilient backing member, the improvement characterized by the resilient backing member having a locally protruded section for imparting to the diaphragm different properties in respect of at least one of the resiliency and tension.

The invention will now be more particularly described with reference to the accompanying drawings in which.

In the drawings and the following description, like portions or parts are denoted by like numerals or characters.

Figure 1:
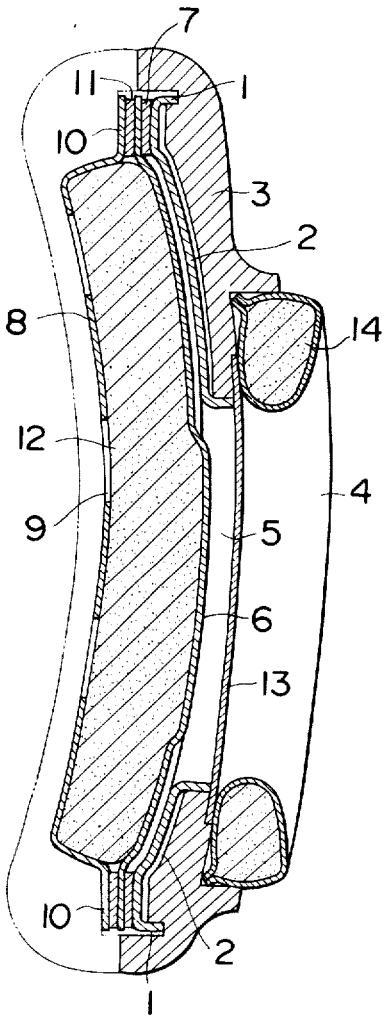
FIG. 1 is a sectional view of one form of piezoelectric electro-acoustic transducer according to the present invention.
Figure 2:
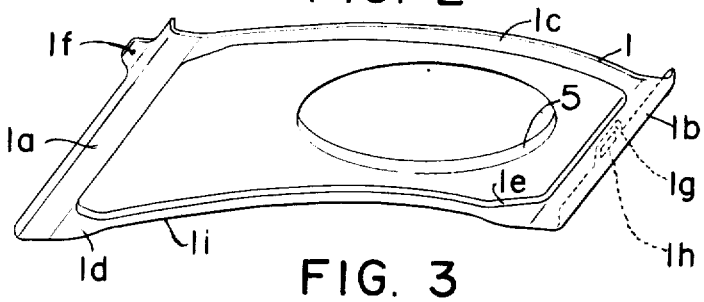
FIG. 2 is a perspective view of a support member.
Figure 3:
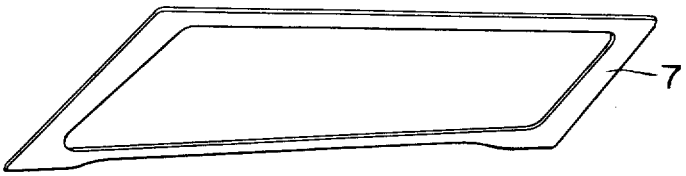
FIG. 3 is a perspective view of a spacer.
Figure 4:
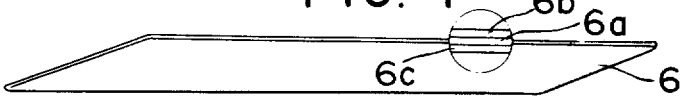
FIG. 4 is a perspective view of a diaphragm.
Figure 5:
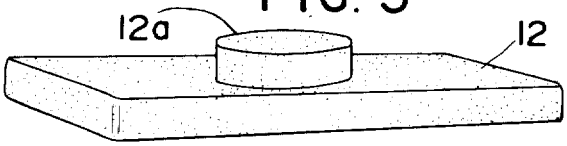
FIG. 5 is a perspective view of one form of a resilient backing member.
Figure 6:
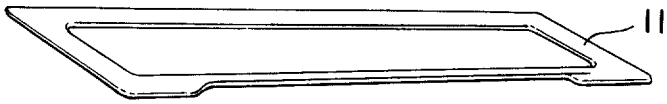
FIG. 6 is a perspective view of another spacer.
Figure 7:
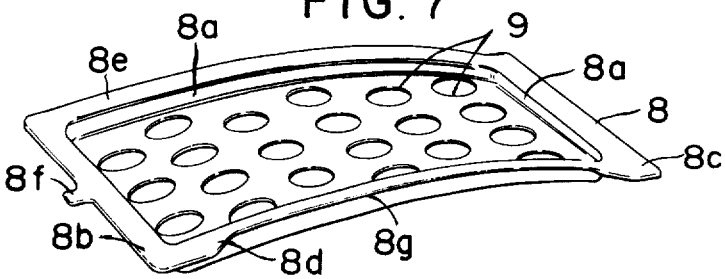
FIG. 7 is a perspective view of a base plate.
Figure 8:
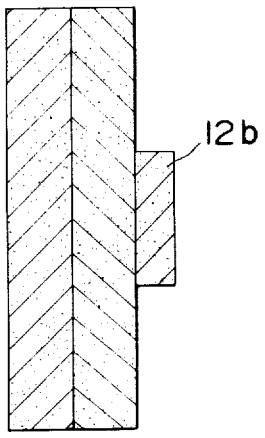
FIG. 8 is a sectional view of another form of the resilient backing member according to the present invention.
Figure 9:
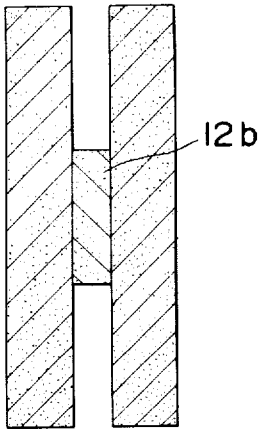
FIG. 9 is a sectional view of a further form of the resilient backing member according to the present invention.

Referring now to FIGS. 1 through 7, there is shown one form of piezoelectric electro-acoustic transducer according to the present invention. Numeral 1 designates a support member formed of a conductive material such as an aluminum. Numeral 2 designates a cover plate formed integrally with the support member. The cover plate 2 is provided at its center portion with an opening 5 which corresponds to a circular opening 4 of a headphone housing 3. Numeral 6 designates a diaphragm made of a thin film 6*a* of high molecular weight polymer material having a flexibility and subjected to have a piezoelectricity, such as polyvinylidene fluoride (PVDF), poly-γ-glutamic acid methyl ester (PMG), covered on both sides with conductive layers which serve as electrodes 6*b* and 6*c*. The diaphragm 6 is fixedly attached at its edge portions to the support member 1 to oppose the cover plate through a spacer 7 of flexible insulating material such as paper which is attached to end portions 1*a*, 1*b*, 1*c* and 1*d* of the support member. Numeral 8 designates a base plate of stiff material which is provided with a predetermined number of openings 9 of a given size. The base plate 8 is adapted to compressively cover with its edge portions 8*b*, 8*c*, 8*d* and 8*e* the diaphragm 6 through another spacer 11. Numeral 12 is a resilient backing member made of a resilient synthetic resin such as polyurethane foam and disposed in its compressed state between the diaphragm 6 and the base plate 8. The resilient backing member 12 compresses with its resiliency the diaphragm 6 against the cover plate 2 to impart the suitable resiliency and/or tension to the diaphragm 6. As stated hereinabove, the resilient backing member 12 is formed from one or more layers of resilient synthetic resin such as polyurethane foam and provided in a portion corresponding to the opening 5 of the cover member 2, with a protruded section. In the embodiment, the resilient backing member 12 is provided in a portion corresponding to the opening 5, with a protruded section 12*a* which is similar in shape to the opening 5 of the cover member 2 and is formed integrally of resilient backing member 12 as illustrated in FIG. 5. In the other embodiment, the resilient backing member 12 is formed in a form in which a separate circular resilient plate 12*b* is attached to a layer of the resilient material to contact with the diaphragm 6, as illustrated in FIG. 8. In a further embodiment, the resilient backing member is prepared in a form in which the separate circular resilient plate 12*b* is sandwiched between the layers of resilient material, as illustrated in FIG. 9. Accordingly, in FIGS. 8 and 9 the locally protruded section, defined by the plate 12*b*, is formed separately from the remainder of the resilient backing member. In preparation, the form and thickness of the prutruded section of the resilient backing member 12 are to be decided depending on a property of the resilient material used for forming the resilient backing member and a property and form of the diaphragm 6. Numeral 13 designates a net of stiff material such as stainless steel and provided with a plurality of holes. The net 13 is adapted for protection and dust-proof of the diaphragm 6.

With the arrangement, it has become possible to obtain improved conversion efficiency and sound characteristics, particularly, improved frequency characteristics of high frequency range by setting the distribution of resiliency and/or tension at the portion of the diaphragm 6 corresponding to the opening 5 of the cover plate 2. For example, the protruded section of the resilient backing member 12 imparts the resiliency and/or tension to a predetermined portion of the diaphragm 6 to improve frequency characteristics of the high frequency range. Consequently, it has become possible to actuate the diaphragm 6 mechanically in two ways. Further, it is noted in the present invention that the diaphragm 6 is supported by the support member 1 and provided with the resiliency and/or tension to vibrate in accordance with input signals.

The present invention as set forth above is not limited to headphones, but is further applicable to other types of piezoelectric electro-acoustic transducers with piezoelectric diaphragm, such as speakers, microphones, etc. with a great advantage and effect such as improvement in frequency characteristics by a simple means such as the resilient backing member 12 which imparts the resiliency and/or tension to the diaphragm 6.

What is claimed is:

1. In a piezoelectric electro-acoustic transducer comprising a diaphragm made of a flexible piezoelectric film material, a support means of a relatively stiff material supporting the edge of said diaphragm, a resilient backing member fitted to the diaphragm to impart at least one of a resiliency and tension to the diaphragm, and a base plate of a stiff material compressing the resilient backing member against said diaphragm, the improvement wherein the resilient backing member includes a locally protruded section for imparting to different parts of the flexible diaphragm different properties in respect of at least one of the resiliency and tension, said locally protruded section occupying less than the full width of said resilient backing member and locally increasing the thickness of said resilient backing member, such that said locally protruding section forms a local thickness discontinuity in said resilient backing member and a local change in the pressure of the resilient backing member against said diaphragm.

2. A piezoelectric electro-acoustic transducer as set forth in claim 1, wherein said resilient backing member includes a first slab-like portion extending the length and width of said resilient backing member but only part of the thickness thereof, said resilient backing member further including a second slab-like portion defining said locally protruded section and of lesser width and length than said first portion, said second slab-like portion being superimposed on said first slab-like portion between opposed portions of said support means, the maximum thickness of said resilient backing member being at least the total thickness of said superimposed first and second slab-like portions, the superimposed first and second slab-like portions defining a step in their uncompressed condition and tending to locally bulge, at said step, said diaphragm away from said base plate.

3. A piezoelectric electro-acoustic transducer as set forth in claim 2, wherein the locally protruded section is formed integrally with the resilient backing member.

4. A piezoelectric electro-acoustic transducer as set forth in claim 2, wherein the locally protruded section is formed separately from the remainder of the resilient backing member.

5. A piezoelectric electro-acoustic transducer as set forth in claim 2, in which said resilient backing member is of resilient polyurethane foam.

6. In a piezoelectric electro-acoustic transducer, the combination comprising:

an edge support member of conductive material;

a cover plate fixed to and extending inboard from said support member and having an opening therethrough well spaced inboard from said edge support member;

a diaphragm made of a thin film of high molecular weight polymer material, said diaphragm film being flexible and having a piezoelectric characteristic, said film being covered on both sides with conductive layers serving as electrodes and being fixedly attached at its edge portions to said edge support member;

a base plate of stiff material provided with openings, the peripheral edges of said base plate, diaphragm and edge support member forming a peripheral sandwich and including means therebetween for securing same together and for insulatingly spacing said diaphragm from said edge support and cover plate, such that said diaphragm extends along said cover plate in close spaced relation therefrom and across said opening in said cover plate;

a resilient backing member of resilient film material disposed in a compressed state between said diaphragm and base plate, said resilient backing member in its said compressed state resiliently pressing the diaphragm toward the cover plate, said resilient backing member including a portion corresponding in size and location to said opening in said cover member and constituting a protruding section of said resilient backing member, said resilient backing member including a first slab-like portion extending the length and width of said resilient backing member but only a part of the thickness thereof, said resilient backing member further including a second slab-like portion defining said locally protruded section and of lesser width and length than said first portion, said second slab-like portion being superimposed on said first said slab-like portion between opposed portions of said edge support member, the thickness of said resilient backing member being at least the total thickness of said superimposed first and second slab-like portions, said first and second slab-like portions defining a step in an uncompressed condition and tending to locally bulge thereat said diaphragm away from said base plate and toward said opening in said cover plate.

7. A piezoelectric electro-acoustic transducer as set forth in claim 6 including a thin perforate platelike member of stiff material carried by said cover plate over said opening in spaced protective relation with said protruding section of said diaphragm.

* * * * *